US005181602A

United States Patent [19]

Kozlowski et al.

[11] Patent Number: 5,181,602

[45] Date of Patent: Jan. 26, 1993

[54] LOCKOUT DEVICE FOR HIGH VOLTAGE CIRCUIT BREAKER

[75] Inventors: Lawrence J. Kozlowski, New Kensington; Lawrence A. Shirey, North Huntingdon, both of Pa.

[73] Assignee: The United States of America as represented by the United States Department of Energy, Washington, D.C.

[21] Appl. No.: 761,437

[22] Filed: Sep. 18, 1991

[51] Int. Cl.[5] ..... H01H 9/28

[52] U.S. Cl. ..... 200/43.015; 200/43.014; 200/43.011

[58] Field of Search ..... 200/43.01, 43.11, 43.14, 200/43.15, 43.19, 43.21, 50 C; 70/DIG. 30, 209

[56] References Cited

U.S. PATENT DOCUMENTS

| | | | |
|---|---|---|---|
| 2,983,799 | 5/1961 | Osieja et al. | 200/43.15 |
| 3,170,050 | 2/1965 | Buturuga | 200/43.19 |
| 3,197,581 | 7/1965 | Clifford | 200/43.21 |
| 3,229,056 | 1/1966 | Turnbull | 200/50 A |
| 3,327,075 | 6/1967 | Phillipson | 200/43.15 |
| 3,629,529 | 12/1971 | Dietz et al. | 200/43.19 |
| 3,632,917 | 1/1972 | Norden | 200/43.14 |
| 4,158,116 | 6/1979 | Krueger | 200/43.19 |
| 4,467,152 | 8/1984 | Gordy | 200/43.21 |
| 4,677,261 | 6/1987 | Nourry | 200/43.15 |
| 4,897,515 | 1/1990 | Zubar et al. | 200/43.19 |

*Primary Examiner*—Henry J. Recla
*Assistant Examiner*—David J. Walczak
*Attorney, Agent, or Firm*—William R. Moser; Judson R. Hightower; Richard E. Constant

[57] ABSTRACT

An improved lockout assembly is provided for a circuit breaker to lock the switch handle into a selected switch position. The lockout assembly includes two main elements, each having a respective foot for engaging a portion of the upper housing wall of the circuit breaker. The first foot is inserted into a groove in the upper housing wall, and the second foot is inserted into an adjacent aperture (e.g., a slot) in the upper housing wall. The first foot is slid under and into engagement with a first portion, and the second foot is slid under and into engagement with a second portion of the upper housing wall. At the same time the repsective two feet are placed in engagement with the respective portions of the upper housing wall, two holes, one on each of the respective two main elements of the assembly, are placed in registration; and a locking device, such as a special scissors equipped with a padlock, is installed through the registered holes to secure the lockout assembly on the circuit breaker. When the lockout assembly of the invention is secured on the circuit breaker, the switch handle of the circuit breaker is locked into the selected switch position and prevented from being switched to another switch position.

15 Claims, 5 Drawing Sheets

LOCKOUT DEVICE FOR HIGH VOLTAGE CIRCUIT BREAKER

GOVERNMENT CONTRACT RIGHTS

The invention described herein was made or conceived in the course of work under Contract No. DE-AC11-88PN38014 between the Department of Energy and Westinghouse Electric Corporation, according to which the U.S. Government has rights in this invention, and title thereto is in the Department of Energy.

TECHNICAL FIELD OF THE INVENTION

The present invention relates to an apparatus for safely and conveniently locking an individual circuit breaker (e.g. a high voltage, 480 volt AC, circuit breaker) in a distribution panel in the off (or on) position as desired without interfering with the remaining circuit breakers in the panel.

BACKGROUND OF THE INVENTION

Many types of circuit breaker lockout devices are known in the prior art. Some have a locking mechanism on the door of a distribution panel. Others have a locking device for an individual circuit breaker.

Presently, there are O.S.H.A. regulations (Regulations 1910.145 and 1910 Subpart s) which require the presence of a safety padlock alone or a special scissors with a padlock locked thereto for locking out individual circuit breakers when one or more repair or maintenance persons work on the circuit being locked out. The number of circuit breaker lockout devices in the prior art that are designed to be locked out with a padlock alone or with the special scissors and a padlock is very limited.

For example, in U.S. Pat. No. 4,467,152, Gordy discloses a circuit breaker lockout assembly which includes a bent pin arrangement (elements 5 and 6 in FIG. 1 of Gordy). The bent pin arrangement must be inserted into element 10 in two pieces during assembly. The two pieces are then welded together, but the weld is a weak spot in the assembly. The scissors (hasp 7) must be perpendicular to the face of the circuit breaker, as shown in FIG. 3. The combined weight of the hasp 7 and padlock 8 (with up to six padlocks) exert a large amount of torque on the elements 5 and 6 and on the handle of the circuit breaker. Furthermore, this arrangement of the hasp 7 and padlock 8 is very bulky and prevents closure of the door of the distribution panel.

In other prior art, in U.S. Pat. No. 4,897,515, Zubar et al disclose the use of a padlock to lock out distribution panel circuit breakers. The Zubar et al device needs to have precision forming to insure that the mating pieces will match, and any deformation of the two mating pieces renders this device useless. The blocking member of the device (element 16 in FIG. 1 of Zubar et al) can easily be bent out of position allowing undesired operation of the circuit breaker. Furthermore, some of the newer circuit breakers have a shallower shoulder than depicted in the Zubar et al patent (element 28 in FIG. 1), and the device may slip over the shoulder allowing unwanted and hazardous operation of the circuit breaker. Also, a screwdriver or other tool is necessary to install the Zubar et al device.

SUMMARY OF THE INVENTION

Accordingly, it is a primary object of the present invention to provide a circuit breaker lockout device that easily permits installation of a padlock alone or a special scissors with a padlock to conform to O.S.H.A. regulations.

Another object of the invention is to provide a circuit breaker lockout device that avoids the creation of large amounts of torque forces on the lockout device when a padlock alone or special scissors with a padlock are installed on the lockout device.

Another object of the invention is to provide a circuit breaker lockout device that does not require installation of two separate parts on the circuit breaker that need to be welded into a unified part once the two parts have been installed on the circuit breaker.

Another object is to provide a circuit breaker lockout device that is not easily defeated once it is installed on the circuit breaker.

Still another object of the invention is to provide a circuit breaker lockout device that permits a door of a distribution panel to be closed once a padlock alone or a special scissors with a padlock are installed on a circuit breaker.

An additional object of the invention is to provide a circuit breaker lockout device that does not require the use of any tool to install the lockout device.

Additional objects, advantages, and novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved circuit breaker lockout assembly is provided. The lockout assembly of the invention is used with a certain type of circuit breaker that has an upper housing wall having an aperture through which the free end of the switch handle of the circuit breaker projects. The aperture in the upper housing wall has a width and a length sufficient to permit the free end of the switch handle to move from an on to an off position and vice versa. The aperture includes along its length a non-grooved portion and a number of grooves which, in effect, widen the width of the aperture at the grooves by the width of the grooves. There is a clearance space under the upper housing wall adjacent to the aperture.

For the type of circuit breaker described above, the lockout assembly of the invention includes first means (a first main element) for engaging a first portion of the upper housing wall and second means (a second main element) for engaging a second portion of the upper housing wall.

More specifically, the first means for engaging a first portion of the upper housing wall (the first main element) includes: a groove entering first foot for entering the grooves of the aperture; means, connected to the first foot, for blocking switch handle motion; and a wall connected to the switch handle motion blocking means. The wall also includes a first hole which is to be placed in registration with a second hole as described below.

Aside from entering the groove, the first foot also slides under a first portion of the upper housing wall in a portion of the clearance space under the upper housing wall adjacent to the aperture and engages the first portion of the upper housing wall.

The second means for engaging a second portion of the upper housing wall (the second main element) includes a second foot for entering the non-grooved portion of the circuit breaker housing aperture and for sliding under the second portion of the upper housing wall, in a portion of the clearance space under the upper housing wall adjacent to the aperture. A main body portion is connected to the second foot and includes a second hole. A handle is connected to the main body portion, and by moving the handle, the second hole is moved into registration with the first hole. Simultaneously, the handle moves the second foot away from the groove entering first foot and into engagement with the second portion of the upper housing wall.

The second main element also includes a guide pin for riding in a complementary guide channel in the first main element. The guide pin and guide channel guide the movement of the second main element with respect to the first main element and the circuit breaker.

When the first hole and the second hole are in registration, they are capable of receiving a shank or jaws of a locking device which prevents the groove entering first foot and the second foot from disengaging from engagement with the first portion and the second portion of the upper housing wall, respectively, whereby a switch-throwing motion of the circuit breaker switch handle is prevented.

Still other objects of the present invention will become readily apparent to those skilled in this art from the following description, wherein there is shown and described a preferred embodiment of this invention. Simply by way of illustration, the invention will be set forth in part in the description that follows and in part will become apparent to those skilled in the art upon examination of the following or may be learned with the practice of the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION

Figure 1:
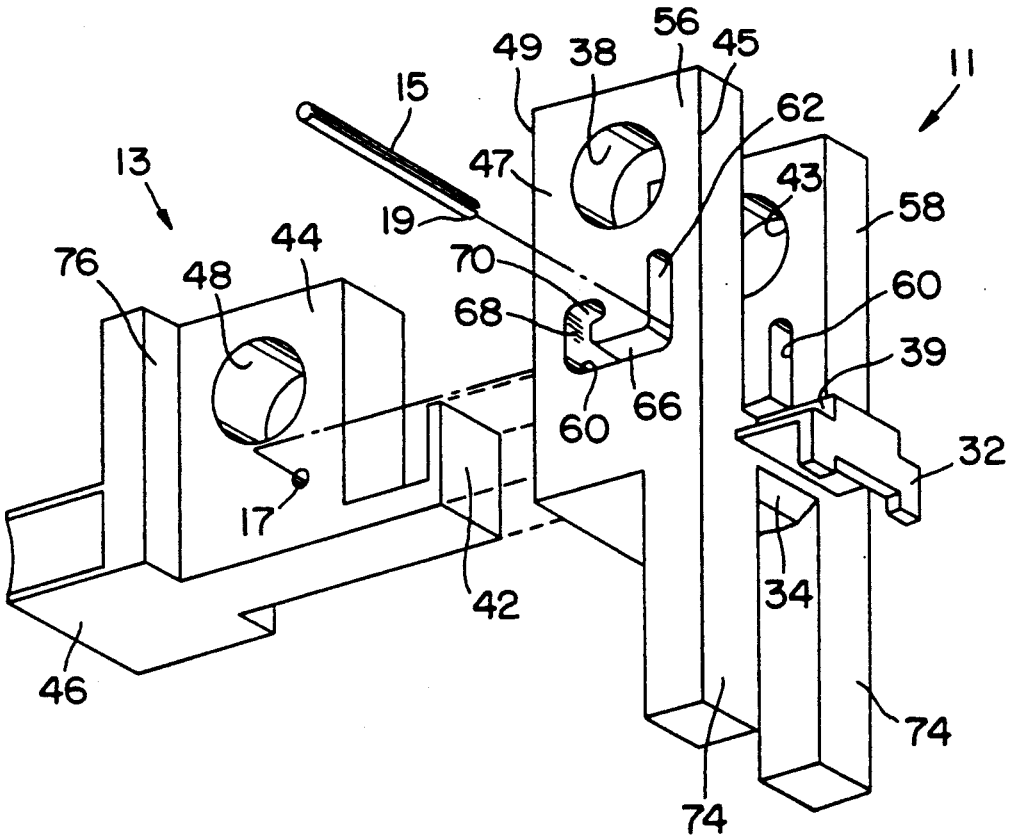
FIG. 1 is an exploded perspective view of a lockout assembly of the invention, the separated components being assembled together to form the lockout assembly shown in FIG. 2.
Figure 2:
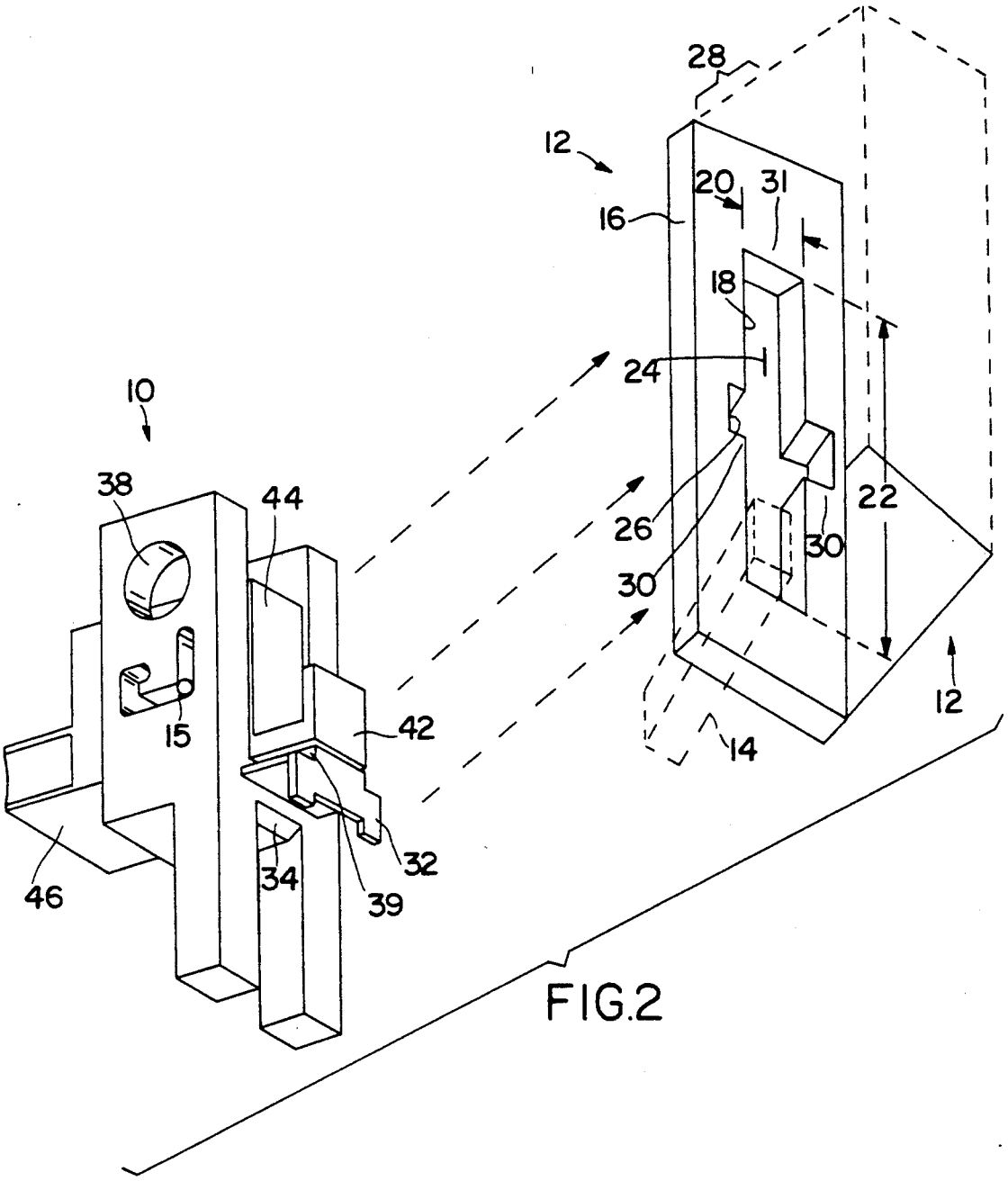
FIG. 2 is an exploded perspective view of a lockout assembly of the invention (formed by assembling the components shown in FIG. 2) removed from a circuit breaker to a position normal to the circuit breaker.

With reference to the drawings, and more particularly to FIG. 1, there is disclosed an exploded perspective view wherein the separated components are first main element 11, second main element 13, and roll pin 15. When the separated components are assembled in accordance with the assembly lines shown in FIG. 1, the lockout assembly 10 of the invention is obtained as shown in FIG. 2. The first main element 11 is fabricated from a single piece of material, such as a single piece of metal (brass) or plastic. Similarly, the second main element 13 is fabricated from a single piece of material, such as a single piece of metal (brass) or plastic. The motion guiding roll pin 15 is made from a sheet metal. After element 13 is inserted between walls 56 and 58 of element 11, small hole 17 in element 13 is placed in registration with guide channels 60 in the walls 56 and 58. Then, one end 19 of the roll pin 15 is passed through the following elements in the order specificed: guide channel 60 in wall 56; small hole 17 in element 13; and guide channel 60 in wall 58. Roll pin 15 is firmly retained in element 13, and the respective ends of the roll pin 15 ride in the respective guide channels 60. No welding is required to install the roll pin in the second main element 13.

Referring to both FIGS. 1 and 2, the lockout assembly 10 is for locking a circuit breaker 12 in a selected off or on position. The off position is shown in FIG. 2. The circuit breaker 12 has a switch handle 14 with a free end. The circuit breaker 12 has an upper housing wall 16 which has an aperture (e.g., a slot) 18 through which the free end of the switch handle 14 projects. The aperture 18 has a width 20 and a length 22 sufficient to permit the free end of the switch handle 14 to move from an on to an off position and vice versa. The aperture 18 includes along its length 22 a non-grooved portion 24 and a number of grooves 26 perpendicular to its length which, in effect, widen the width 20 of the aperture 18 at the grooves 26 by the width of the grooves 26. There is a clearance space 28 under the upper housing wall 16 adjacent to the aperture 18.

The lockout assembly 10 includes the first main element 11 for engaging a first portion 30 of the upper housing wall 16. More specifically, the first main element 11 includes groove entering first foot 32 for entering the grooves 26 of the aperture 18, for sliding under a first portion 30 of the upper housing wall 16 in a portion of the clearance space 28 under the upper housing wall 16 adjacent to the aperture 18, and for engaging the first portion 30 of the upper housing wall 16. The first foot 32 includes rear flanges 39 for guiding the first foot 32 into a groove 26 in the circuit breaker 12 housing wall 16.

The first main element 11 also includes switch-handle-motion blocker portion 34, connected to the groove entering first foot 32. The first main element 11 also includes two opposing walls 56 and 58 connected to the switch-handle-motion blocker 34. The walls 56 and 58 lie in parallel planes. The walls 56 and 58 include first holes 38 and 43, respectively. Each of the two opposing walls 56 and 58 includes a respective guide channel 60 for receiving respective ends of the motion guiding roll pin 15 and for guiding motion of the second main element 13.

The two opposing walls 56 and 58 include a bottom portion 45 and a top portion 47. The bottom portion 45 is located near the upper housing wall 16 when the lockout assembly 10 is installed on the circuit breaker 12. The two opposing walls 56 and 58 include flat upper surfaces 49.

Each of the two opposing walls 56 and 58 includes a bar member 74 projecting from a respective opposing wall, in the respective plane of the respective opposing wall. The bar members 74 serves to straddle (see FIG. 4) and to contact the switch handle 14 in the event that the lockout assembly 10 is twisted while on the circuit breaker 12. In this way, the bar members 74 prevent the lockout assembly 10 from being twisted off of the circuit breaker 12.

The main body portion 44 (see FIG. 1) of element 13 includes guide flange 76 for sliding upon the flat upper surfaces 49 of element 11, whereby the second main element 13 is supported by the two opposing walls 56 and 58 of element 11.

The respective guide channels 60 in the respective walls 56 and 58 of element 11 include first vertical portions 62 located at the respective bottom portion 45 of the opposing walls 56 and 58. The first vertical guide channel portions 62 serve to guide the second foot 42 of element 13 into engagement with the second portion 31 of the upper housing wall 16 when the handle 46 is moved in the direction toward the second portion 31. As the handle 46 is moved from the position shown in FIG. 3 to the position shown in FIG. 4, the ends of the guide pin 15 move in the first vertical guide channel portions 62 from the position shown in FIG. 3 to the position shown in FIG. 4.

The guide channels 60 also include first horizontal portions 66 connected to respective ends of the respective first vertical guide channel portions 62 and project horizontally therefrom. The first horizontal guide channel portions 66 serve to guide the second main element 13 away from the circuit breaker 12 subsequent to disengagement of the second foot 42 from the second portion 31 of the circuit breaker 12 housing wall 16. Also, the first horizontal guide channel portions 66 serve to guide the second main element 13 toward the circuit breaker 12 prior to moving the second foot 42 into engagement with the second portion 31 of the circuit breaker 12 housing wall 16.

The guide channels 60 also include second vertical portions 68 connected to respective upper ends of the respective first horizontal guide channel portions 66, and the guide channels 60 also include second horizontal portions 70 connected to respective ends of the respective second vertical guide channel portions 68. The second horizontal guide channel portions 70 serve to receive the ends of the motion guiding roll pin 15 and to retain element 13 above the upper housing wall 16 when element 11 is firstly engaged with or secondly disengaged from the first portion 30 of the upper housing wall 16.

During installation of the lockout assembly 10 on the circuit breaker 12, the second foot 42 enters the non-grooved portion 24 of the aperture 18 and is slid under the second portion 31 of the upper housing wall 16 in a portion of the clearance space 28 under the upper housing wall 16 adjacent to the aperture 18. The second main element 13 also includes a main body portion 44 connected to the second foot 42. The main body portion 44 includes a second hole 48. The second main element 13 includes a handle 46 connected to the main body portion 44. The handle 46 serves a dual purpose. The handle 46 is used to move the second hole 48 into registration with the first hole 38 and to move the second foot 42 away from the groove entering first foot 32 and into engagement with the second portion 31 of the upper housing wall 16.

Figure 3:
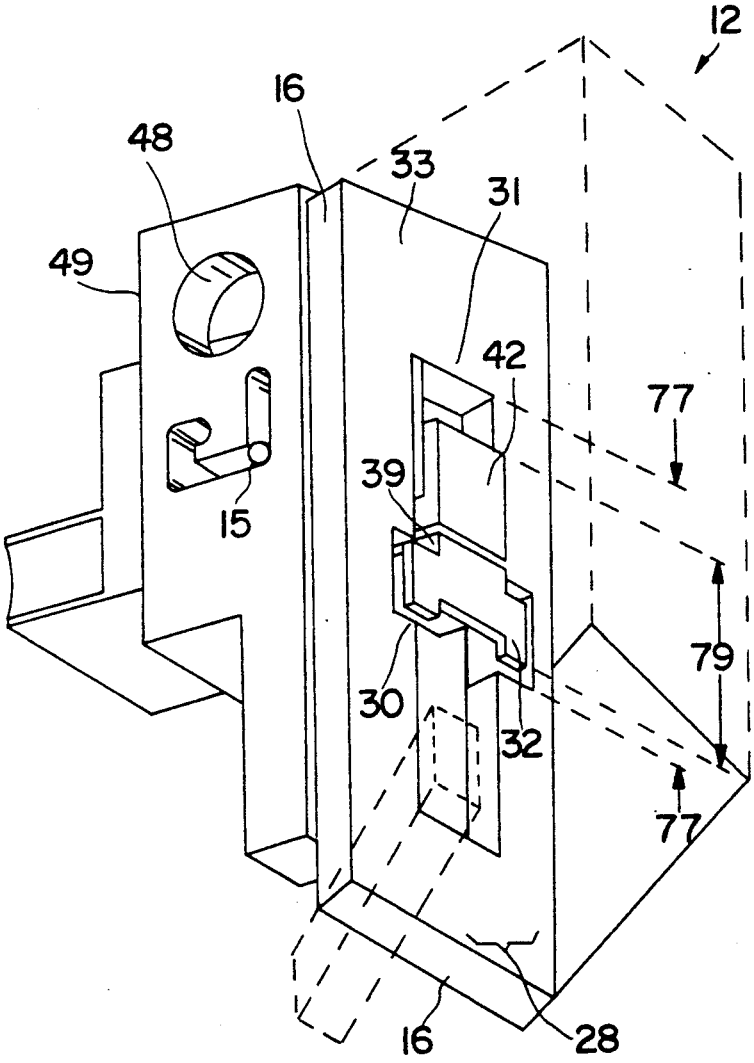
FIG. 3 is a view of the lockout assembly of the invention shown in FIG. 2 placed onto the upper housing wall of the circuit breaker, with the groove entered by the first foot and with the aperture entered by the second foot.

As shown in FIG. 3, the lockout assembly 10 of the invention shown in FIG. 2 has been brought into contact with the upper wall 16 of the circuit breaker 12. As shown in FIG. 3, the first foot 32 and the second foot 42 lie outside the plane in which the bottom side 33 of the wall 16 lies. More specifically, the first foot 32 and the second foot 42 lie in the clearance space 28 under the bottom side 33 of the wall 16.

Figure 4:
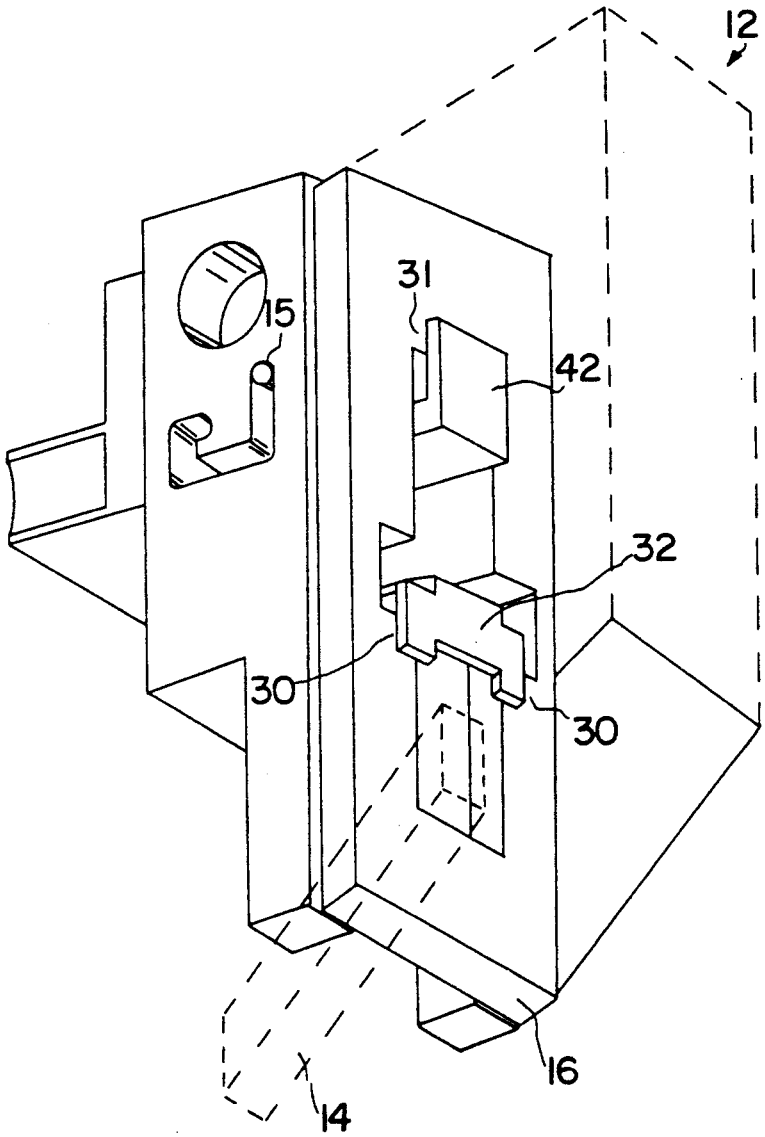
FIG. 4 shows the lockout assembly of FIG. 3 adjusted so that the first foot and the second foot engage respective portions of the circuit breaker upper housing wall adjacent the aperture in the upper housing wall.

As shown in FIG. 4, the lockout assembly 10 of the invention shown in FIG. 3 has been installed on the wall 16. More specifically, the leading ends of the first foot 32 have been pushed into engagement with portions 30 of the bottom side 33 of the wall 16. The leading end of the second foot 42 has been pushed into engagement with portion 31 of the bottom side 33 of the wall 16. Now, in FIG. 4, the first hole 38 and the second hole 48 are in registration.

Figure 5:
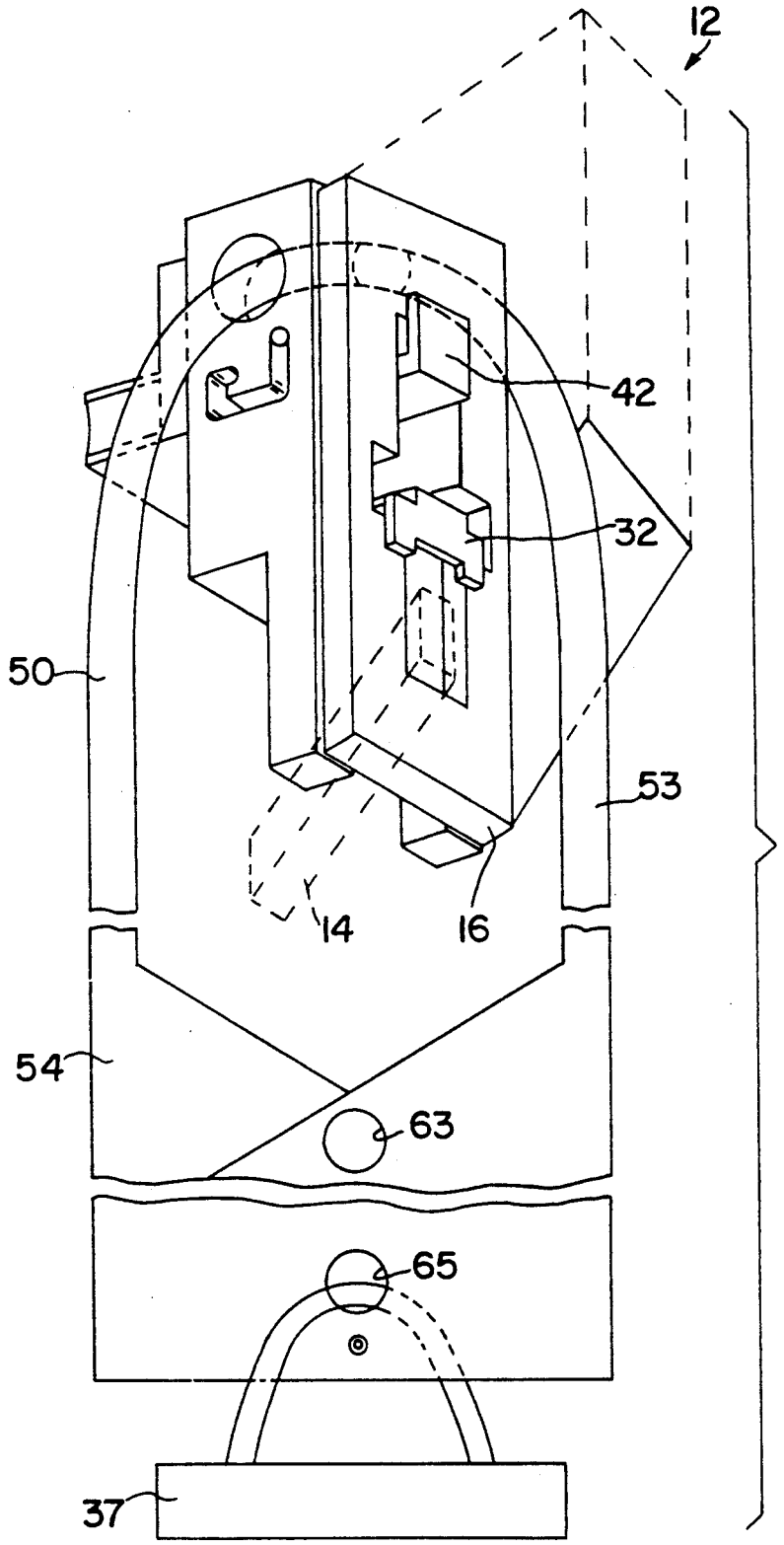
FIG. 5 shows the lockout assembly of FIG. 4 installed on the upper housing wall of the circuit breaker and including a special scissors and padlock as required by O.S.H.A. regulations secured to the lockout assembly.

As shown in FIG. 5, when the first hole 38 and the second hole 48 are in registration, they are capable of receiving a shank 50 of a locking device 54 which prevents the groove entering first foot 32 and the second foot 42 from disengaging from engagement with the first portion 30 and the second portion 31 of the upper housing wall 16, respectively, whereby a switch-throwing motion of the circuit breaker 12 switch handle 14 is prevented.

More specifically, the locking device 54 is a special scissors 54 required by O.S.H.A. regulations whose shank 50 passes through the registered holes 38, 48, and 43. The other shank 53 of the special scissors 54 also passes through the registered holes 38, 48, and 43. The special scissors 54 has a plurality of holes 63 and 65, to accommodate different padlocks, perhaps having shanks of various outer diameters. Different padlocks are used by different repair or maintenance personnel. Thus, when the special scissors 54 required by O.S.H.A. regulations has provision for a plurality of padlocks, a plurality of repair or maintenance personnel can work on the same circuit protected by the circuit breaker simultaneously. Padlock 37 is installed in hole 65. It is noted that the special scissors 54 and the padlock 37 are hanging vertically and are substantially coplanar with the plane in which the registered holes 38, 48, and 43 reside.

With the hanging of the special scissors 54 and the padlock 37, relatively small torque forces are exerted on the lockout assembly 10 and on the circuit breaker 12.

Because the hanging special scissors 54 and padlock 37 provide such a low profile, a door for a circuit breaker distribution panel (not shown) would be permitted to close even with lockout assembly 10 of the invention, the special scissors 54, and the padlock 37 installed on a circuit breaker in the panel.

When installed on the circuit breaker 12, with holes 38, 48, and 43 locked in registration, the lockout assembly 10 of the invention is strongly engaged with the respective first portions 30 and second portion 31 of the upper housing wall 16. In this respect, it would be very difficult to remove the lockout assembly 10 from the circuit breaker 12 without doing serious damage to the circuit breaker 12. Thus, the lockout assembly 10 of the invention is not easily defeated.

Furthermore, it is clear from the description above, once the component parts shown in FIG. 1 are assembled into the lockout assembly 10 of the invention shown in FIG. 2, no tools are needed to install a lockout assembly 10 of the invention on to remove a lockout assembly 10 from a circuit breaker 12.

In accordance with another aspect of the invention, the housing wall aperture 18 and grooves 26 lie in a plane. As shown in FIG. 3, there is a predetermined first distance 77 in the plane between the top of a groove and the bottom of the aperture 18. The groove entering first foot 32 of the first main element 11 and the second foot 42 of the second main element 13 have respective bottom sides that are capable of being located in a common plane. The groove entering first foot 32 and second foot 42 are dimensioned such that, when the respective bottom sides of the groove entering first foot 32 and the second foot 42 are in a common plane, there is a predetermined second distance 79 in the plane between one end of the groove entering first foot 32 and an opposite end of the second foot 42. The second distance 79 can be greater than the first distance 77 (although this relationship is not shown in the drawings), and, in order to install the groove entering first foot 32 under the first portion 30 of the upper housing wall 16, the second foot 42 needs to be raised out of and above the common plane with the groove entering first foot 32 before attempting to install the first foot 32.

Although the lockout assembly of the invention can be used with any suitable circuit breaker, it is especially useful for locking a high voltage circuit breaker in a selected switch positiion. More specifically, the lockout assembly of the invention can be used on a Westinghouse, Series C, Industrial Circuit Breaker, e.g., Model HFD 65k, designed for 480 volt applications and rated at 100 AMPS at 600 VAC.

Numerous benefits result from employing the principles of the invention. With the invention, a circuit breaker lockout device is provided that easily permits installation of a padlock alone or a special scissors with a padlock on a circuit breaker to conform to O.S.H.A. regulations. By employing the invention, a circuit breaker lockout device is provided that avoids the creation of large amounts of torque forces on the lockout device when a padlock alone or special scissors with a padlock are installed on the lockout device.

With the invention, a circuit breaker lockout device is provided that does not require installation of two separate parts on the circuit breaker that need to be welded into a unified part once the two parts have been installed on the circuit breaker. Also, with the invention, a circuit breaker lockout device is provided that is not easily defeated once it is installed on the circuit breaker. By employing the invention, a circuit breaker lockout device is provided that permits a door of a distribution panel to be closed once a padlock alone or a special scissors with a padlock are installed on a circuit breaker. Still further, with the invention, a circuit breaker lockout device is provided that does not require the use of any tool to install the lockout device.

The foregoing description of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A lockout assembly for locking a circuit breaker in a selected off or on position, the circuit breaker having a switch handle with a free end, the circuit breaker having an upper housing wall having a slot through which the free end of the switch handle projects, the slot in the upper housing wall having a width and a length sufficient to permit the free end of the switch handle to move from an on to an off position and vice versa, the slot having a groove perpendicular to its length, there being a clearance space under the upper housing wall adjacent to the slot, said lockout assembly comprising:

first means for engaging a first portion of the upper housing wall, including groove-entering first foot means for entering the groove of the slot, for sliding under a first portion of the upper housing wall in a portion of the clearance space under the upper housing wall adjacent to the slot, and for engaging the first portion of the upper housing wall, said first housing wall engaging means also including means for blocking switch handle motion, said switch handle motion blocking means connected to said groove-entering first foot means, said first housing wall engaging means also including a wall, said first engaging means wall connected to said switch handle motion blocking means and including a first hole, and second means for engaging a second portion of the upper housing wall, said second housing wall engaging means including second foot means for entering the non-grooved portion of the slot and sliding under the second portion of the upper housing wall in a portion of the clearance space under the upper housing wall adjacent to the slot, said second housing wall engaging means also including a main body portion connected to said second foot means, said main body portion including a second hole, and said second housing wall engaging means also including a handle means connected to said main body portion, said handle means for moving said second hole into registration with said first hole and for moving said second foot means away from said groove-entering first foot means and into engagement with the second portion of the upper housing wall, wherein, when said first hole and said second hole are in registration, they are capable of receiving a shank or jaws of a locking device which prevents said groove-entering first foot means and said second foot means from disengaging from engagement with the first portion and the second portion of the upper housing wall, respectively, whereby a switch-throwing motion of the circuit breaker switch handle is prevented.

2. The lockout assembly described in claim 1 wherein said first housing wall engaging means is fabricated from a single piece of material.

3. The lockout assembly described in claim 1 wherein said first housing wall engaging means is fabricated from a single piece of metal material.

4. The lockout assembly described in claim 1 wherein said first housing wall engaging means is fabricated from a single piece of plastic material.

5. The lockout assembly described in claim 1 wherein said second housing wall engaging means is fabricated from two pieces of material.

6. The lockout assembly described in claim 1 wherein said second housing wall engaging means is fabricated from two pieces of metal material.

7. The lockout assembly described in claim 1 wherein said groove entering first foot means includes rear flange means for guiding said first foot means into a groove in the circuit breaker housing wall.

8. The lockout assembly described in claim 1, wherein:

said main body portion of said second housing wall engaging means includes means for guiding motion of said second housing wall engaging means, and said first housing wall engaging means includes two opposing walls connected to said switch handle motion blocking means, each of said two opposing walls including guide channel means for receiving said motion guiding means and for guiding motion of said second housing wall engaging means.

9. The lockout assembly described in claim 8, wherein:

said two opposing walls include a bottom portion and a top portion, said bottom portion being located near the upper housing wall when the lockout assembly is installed on the circuit breaker, said guide channel means include first vertical portions located at said respective bottom portion of said opposing walls, said first vertical guide channel portions for guiding said second housing wall engaging means into engagement with the second portion of the upper housing wall, said guide channel means include first horizontal portions connected to respective ends of the respective first vertical guide channel portions and projecting horizontally therefrom, said first horizontal guide channel portions for guiding said second housing wall engaging means away from the circuit breaker subsequent to disengagement from the circuit breaker housing wall, and for guiding said second housing wall engaging means toward the circuit breaker prior to engagement with the circuit breaker housing wall, said guide channel means include second vertical portions connected to respective upper ends of said respective first horizontal guide channel portions, and said guide channel means include second horizontal portions connected to respective ends of said respective second vertical guide channel portions, said second horizontal guide channel portions for receiving said motion guiding means and retaining said second housing wall engaging means above the upper housing wall when said first means for engaging a first portion of the upper housing wall is being engaged with or disengaged from the first portion of the upper housing wall.

10. The lockout assembly described in claim 8, wherein:

said two opposing walls include flat upper surfaces, and said main body portion includes guide flange means for sliding upon said flat upper surfaces, whereby said main body portion is supported by said two opposing walls.

11. The lockout assembly described in claim 8 wherein said motion guiding means is comprised of pin means projecting from opposite sides of said main body portion of said second housing wall engaging means.

12. The lockout assembly described in claim 11 wherein said pin means is comprised of a roll pin.

13. The lockout assembly described in claim 8, wherein:

each of said two opposing walls lies in a plane, the planes of said two opposing walls being parallel, each of said two opposing walls includes a bar member means projecting from a respective opposing wall in the respective plane of the opposing wall, said bar member means for contacting the switch handle in the event that said lockout assembly is twisted while on the circuit breaker, for preventing said lockout assembly from being twisted off of the circuit breaker.

14. A lockout assembly for locking a circuit breaker in a selected off or on position, the circuit breaker having a switch handle with a free end, the circuit breaker having an upper housing wall having an aperture through which the free end of the switch handle projects, the aperture in the upper housing wall having a width and a length sufficient to permit the free end of the switch handle to move from an on to an off position and vice versa, the aperture including along its length a non-grooved portion and a number of grooves which, in effect, widen the width of the aperture at the grooves by the width of the grooves, there being a clearance space under the upper housing wall adjacent to the aperture, said lockout assembly comprising:

first means for engaging a first portion of the upper housing wall, including groove entering first foot means for entering the grooves of the aperture, for sliding under a first portion of the upper housing wall in a portion of the clearance space under the upper housing wall adjacent to the aperture, and for engaging the first portion of the upper housing wall, said first housing wall engaging means also including means for blocking switch handle motion, said switch handle motion blocking means connected to said groove entering first foot means, said first housing wall engaging means including two opposing walls connected to said switch handle motion blocking means, each of said two opposing walls including guide channel means for receiving motion guiding means for guiding motion of said second housing wall engaging means, said motion guiding means comprised of pin means projecting from opposite sides of said main body portion of said second housing wall engaging means, said two first engaging means walls connected to said switch handle motion blocking means and each of said walls including a respective first hole aligned with the hole of the other wall, said two opposing walls including flat upper surfaces, and second means for engaging a second portion of the upper housing wall, said second housing wall engaging means including second foot means for entering the non-grooved portion of the aperture and sliding under the second portion of the upper housing wall in a portion of the clearance space under the upper housing wall adjacent to the aperture, said second housing wall engaging means also including a main body portion connected to said second foot means, said main body portion including a second hole, said main body portion of said second housing wall engaging means including means for guiding motion of said second housing wall engaging means, said main body portion including guide flange means for sliding upon said flat upper surfaces of said two opposing walls, whereby said main body portion is supported by said two opposing walls, and said second housing wall engaging means also including a handle means connected to said main body portion, said handle means for moving said second hole into registration with said first aligned holes and for moving said second foot means away from said groove-entering first foot means and into engagement with the second portion of the upper housing wall, wherein, when said first aligned holes and said second hole are in registration, they are capable of receiving a shank or jaws of a locking device which prevents said groove entering first foot means and said second foot means from disengaging from engagement with the first portion and the second portion of the upper housing wall, respectively, whereby a switch-throwing motion of the circuit breaker switch handle is prevented.

15. A lockout assembly for locking a circuit breaker in a selected off or on position, the circuit breaker having a switch handle with a free end, the circuit breaker having an upper housing wall having an aperture through which the free end of the switch handle projects, the aperture in the upper housing wall having a width and a length sufficient to permit the free end of the switch handle to move from an on to an off position and vice versa, the aperture including along its length a non-grooved portion and a number of grooves which, in effect, widen the width of the aperture at the grooves by the width of the grooves, there being a clearance space under the upper housing wall adjacent to the aperture, said lockout assembly comprising:

first means for engaging a first portion of the upper housing wall, including groove entering first foot means for entering the grooves of the aperture, for sliding under a first portion of the upper housing wall in a portion of the clearance space under the upper housing wall adjacent to the aperture, and for engaging the first portion of the upper housing wall, said first housing wall engaging means also including means for blocking switch handle motion, said switch handle motion blocking means connected to said groove entering first foot means, said first housing wall engaging means including two opposing walls connected to said switch handle motion blocking means, each of said two opposing walls including guide channel means for receiving motion guiding means for guiding motion of said second housing wall engaging means, said two first engaging means walls connected to said switch handle motion blocking means and each of said walls including a respective first hole aligned with the hole of the other wall, each of said two opposing walls including a bottom portion and a top portion, said bottom portion being located near the upper housing wall when the lockout assembly is installed on the circuit breaker, and second means for engaging a second portion of the upper housing wall, said second housing wall engaging means including second foot means for entering the non-grooved portion of the aperture and sliding under the second portion of the upper housing wall in a portion of the clearance space under the upper housing wall adjacent to the aperture, said second housing wall engaging means also including a main body portion connected to said second foot means, said main body portion including a second hole, said main body portion of said second housing wall engaging means including means for guiding motion of said second housing wall engaging means, said main body portion including guide flange means for sliding upon said flat upper surfaces of said two opposing walls, whereby said main body portion is supported by said two opposing walls, and said second housing wall engaging means also including a handle means connected to said main body portion, said handle means for moving said second hole into registration with said first aligned holes and for moving said second foot means away from said groove entering first foot means and into engagement with the second portion of the upper housing wall, said guide channel means including first vertical portions located at said respective bottom portion of said opposing walls, said first vertical guide channel portions for guiding said second housing wall engaging means into engagement with the second portion of the upper housing wall, said guide channel means including first horizontal portions connected to respective ends of the respective first vertical guide channel portions and projecting horizontally therefrom, said first horizontal guide channel portions for guiding said second housing wall engaging means away from the circuit breaker subsequent to disengagement from the circuit breaker housing wall, and for guiding said second housing wall engaging means toward the circuit breaker prior to engagement with the circuit breaker housing wall, said guide channel means including second vertical portions connected to respective upper ends of said respective first horizontal guide channel portions, and said guide channel means including second horizontal portions connected to respective ends of said respective second vertical guide channel portions, said second horizontal guide channel portions for receiving said motion guiding means and retaining said second housing wall engaging means above the upper housing wall when said first means for engaging a first portion of the upper housing wall is being engaged with or disengaged from the first portion of the upper housing wall.

wherein, when said first aligned holes and said second hole are in registration, they are capable of receiving a shank or jaws of a locking device which prevents said groove entering first foot means and said second foot means from disengaging from engagement with the first portion and the second portion of the upper housing wall, respectively, whereby a switch-throwing motion of the circuit breaker switch handle is prevented.

* * * * *